US005669155A

United States Patent [19]

Hughes et al.

[11] Patent Number: 5,669,155

[45] Date of Patent: Sep. 23, 1997

[54] SUCTION DRUM SYSTEM FOR PROCESSING WEB MATERIALS PARTICULARLY KNITTED FABRICS

[75] Inventors: Robert J. Hughes; Michael S. Leonard; William C. Hardin, Jr., all of Lexington, N.C.

[73] Assignee: Tubular Textile LLC, Lexington, N.C.

[21] Appl. No.: 716,939

[22] Filed: Sep. 20, 1996

Related U.S. Application Data

[60] Provisional application No. 60/004,871 Oct. 4, 1995.

[51] Int. Cl.[6] ..... F26B 11/02

[52] U.S. Cl. ..... 34/115

[58] Field of Search ..... 34/115, 125, 128; 162/205, 207; 26/18.6, 74, 75, 81, 84; 68/19.1, 20, 903

[56] References Cited

U.S. PATENT DOCUMENTS

| | | | |
|---|---|---|---|
| 2,303,123 | 11/1942 | Johannessen | 34/9 |
| 2,825,979 | 3/1958 | Verwayen et al. | 34/114 |
| 3,119,140 | 1/1964 | Sallet | 15/306 |
| 3,122,428 | 2/1964 | Wiedermann | 34/115 |
| 3,291,482 | 12/1966 | Stemmler | 271/11 |
| 3,345,756 | 10/1967 | Bryand et al. | 34/115 X |
| 3,398,464 | 8/1968 | Fleissner | 34/122 |
| 3,460,898 | 8/1969 | Fleissner | 8/149.1 |
| 3,688,354 | 9/1972 | Cohn et al. | 26/52 |
| 3,752,639 | 8/1973 | Thagard, Jr. | 432/59 |
| 3,837,796 | 9/1974 | Fleissner | 8/21 R |
| 3,946,497 | 3/1976 | Carter | 34/92 |
| 3,961,400 | 6/1976 | Schmid | 34/115 X |
| 4,127,263 | 11/1978 | Wenthe | 271/96 |
| 4,145,819 | 3/1979 | Fleissner | 34/68 |
| 4,328,626 | 5/1982 | Leitner | 34/115 |
| 4,753,693 | 6/1988 | Street | 156/62.8 |
| 4,932,138 | 6/1990 | Liedes et al. | 34/115 X |
| 4,974,340 | 12/1990 | Wedel et al. | 34/115 |
| 5,135,614 | 8/1992 | Aula et al. | 34/117 X |
| 5,185,940 | 2/1993 | Fleissner | 34/115 |
| 5,318,705 | 6/1994 | Pellerin | 210/360.1 |
| 5,358,233 | 10/1994 | Ganter | 271/183 |
| 5,371,954 | 12/1994 | Pinter et al. | 34/115 |
| 5,465,502 | 11/1995 | Holik et al. | 34/115 |

*Primary Examiner*—John M. Sollecito
*Assistant Examiner*—Steve Gravini
*Attorney, Agent, or Firm*—Schweitzer Cornman Gross & Bondell LLP

[57] ABSTRACT

A suction drum dryer, for knitted fabrics and the like, is provided with an adjustable width bellows mechanism for masking side margins of the drums not occupied by the fabric web. Ambient air draw into the suction drums is thus caused to flow substantially exclusively through the material to be processed. Significantly improved operating efficiencies are realized, as well as significantly higher production output from a given piece of equipment.

10 Claims, 7 Drawing Sheets

FIG. 1
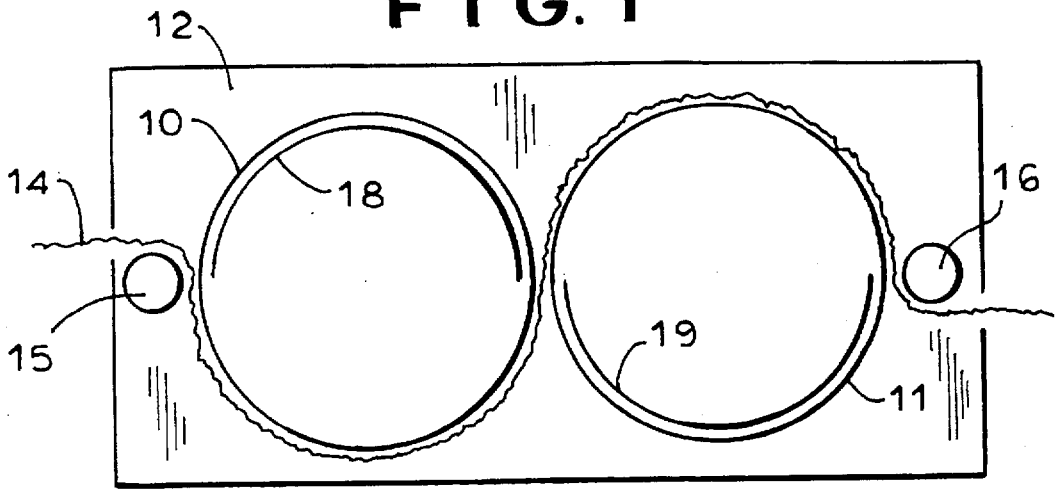
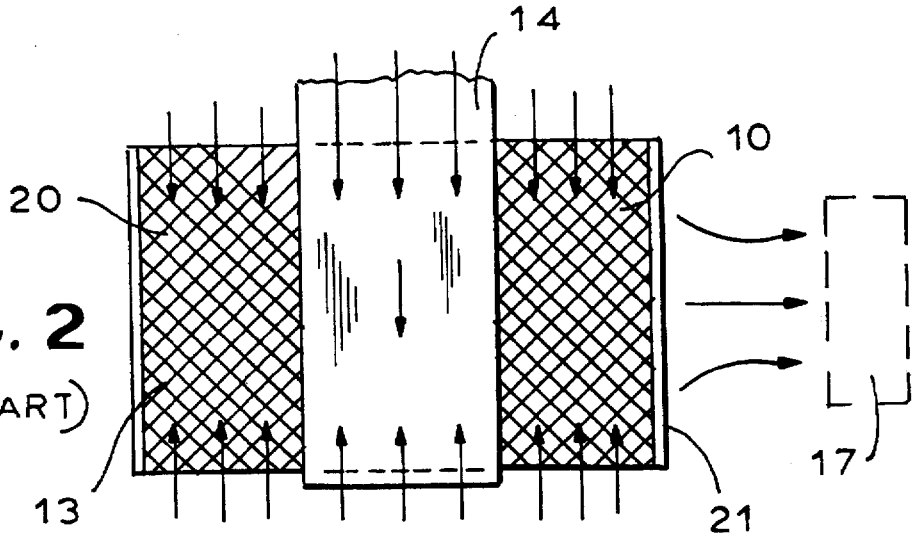
FIG. 2
(PRIOR ART)
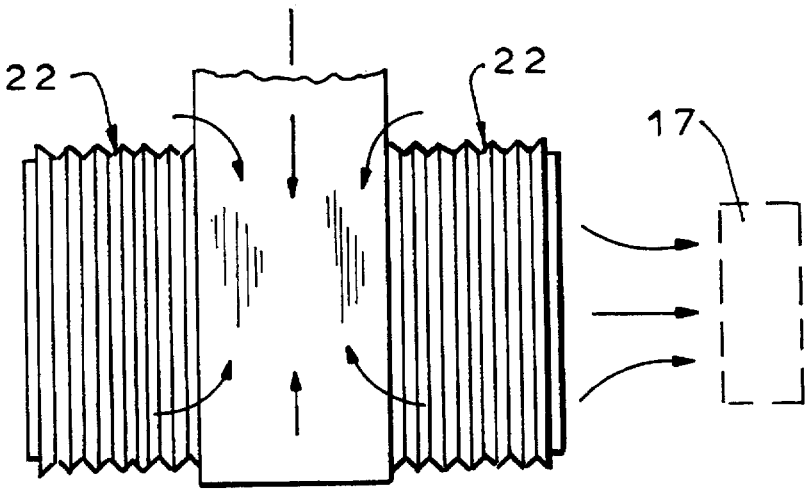
FIG. 3

FIG. 8
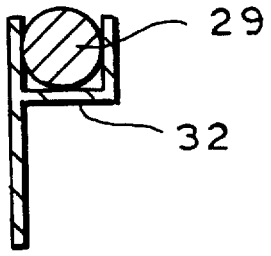
FIG. 12
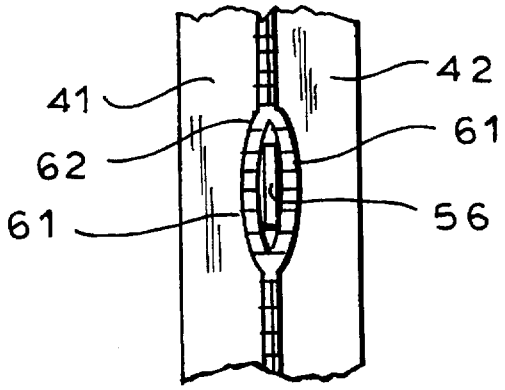
FIG. 11
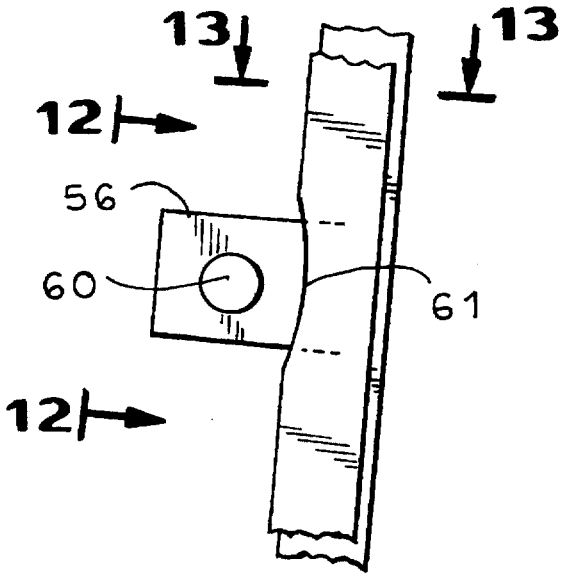
FIG. 13
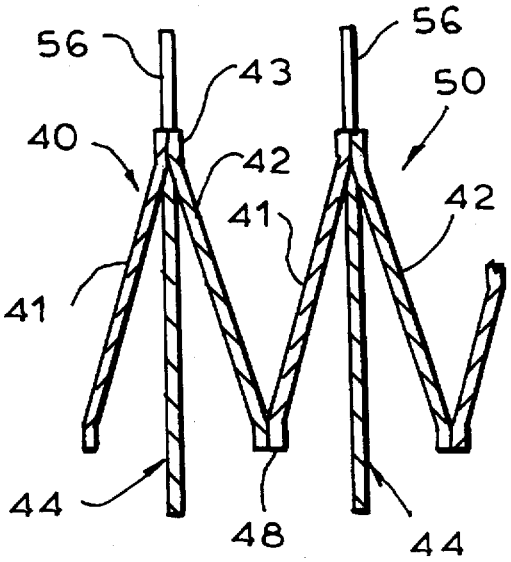
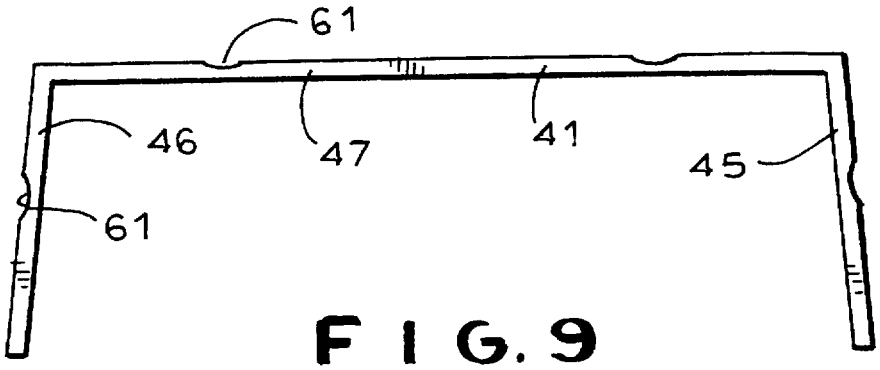
FIG. 9

SUCTION DRUM SYSTEM FOR PROCESSING WEB MATERIALS PARTICULARLY KNITTED FABRICS

This application claims priority of provisional application Ser. No. 60/004,871, filed Oct. 4, 1995.

BACKGROUND AND SUMMARY OF THE INVENTION

In the processing of fabrics, one of the commonly employed processing steps involves continuous drying of a moving fabric web. One well known and commonly utilized apparatus for this purpose is the suction drum dryer, which comprises one or more processing drums mounted for rotation in a dryer housing and having a drum surface which is highly permeable to the flow of air. For example, the drum surface can be of sheet metal formed with a large number of closely spaced through openings, or it may be formed of a mesh material. In either case, the drum provides support for a fabric web travelling thereover, while accommodating the free flow of air through the fabric and through the cylindrical wall of the dryer drum. The interior of each suction drum communicates with a suction blower, such that ambient air surrounding the drum tends to be drawn into the drum, passing through the fabric to achieve desired drying or other processing.

Suction drum dryers of the type described above are, in general, well known. Typically, fabric processed in such dryers passes over only a portion of the circumference of a drum. In the processing of tubular knitted fabric, for example, a web of fabric may typically be directed over approximately 180° of the circumference of a first drum, and then be transferred to a second drum, passing over approximately one half the circumference of the second drum. In such cases, the drums typically are provided with means for masking off the arcuate segment of the drum which does not support fabric during processing, so that air flow is usefully limited to that arcuate portion of the drum which is involved in the processing of fabric.

In a suction drum dryer installation, the drum or drums are of a fixed width, for accommodating a predetermined maximum width of fabric web to be processed. In many cases, however, the width of a web to be processed may be only a fraction of the full width capacity of the drum. In such cases, large portions of the processing section of a drum are directly open to the surrounding ambient. This is not only wasteful of energy in the circulation of air that performs no function but also reduces the efficiency of the flow of processing air through the fabric, inasmuch as some of the air finds it easier to flow around the fabric and through open portions of the drum than to flow directly through the fabric. In some cases, this problem can be partially alleviated by processing of multiple narrow webs on a side-by-side basis. However, not all processing lines can accommodate side-by-side processing which, in any event, only alleviates and does not solve the problem. Efforts have also been made to mask off unused lateral portions of the drums by wrapping of the drum with one or more strips of suitable material, such as Teflon. However, this requires the operator to enter the interior of the dryer housing, which may be very hot, and to manually wrap the drum with strips of material.

In accordance with the present invention, a novel and improved suction drum system is provided which includes masking means for selectively and adjustably masking at least one, and more preferably both lateral margins of a perforate suction dryer drum, in order to effectively confine the flow of processing air through those portions of the drum actively supporting fabric to be processed. In a preferred system according to the invention, masking means are provided at opposite sides of the drum, extending circumferentially over substantially the entire processing portion of the drum for masking opposite side lateral portions thereof. The masking elements are laterally adjustable under the control of an operator, as an in-process adjustment if necessary or desired. The arrangement of the invention enables practical, day-to-day control over the effective width of the suction drum dryer, which not only increases the overall efficiency of the operation in very significant ways, but also enables significant increases in the productivity of a given piece of equipment, since substantially the entire capacity of the suction blower can be utilized in causing the flow of processing air through the fabric.

In a particularly advantageous form of the invention, the adjustable masking means is in the form of a bellows structure at each side, defined by a fixed outer wall and a transversely movable inner wall. The side wall elements conform closely to the surface of the suction drum, over as much as practicable of the processing portion thereof, and are connected by a series of internally supported bellows panels. The arrangement provides a practical, economically fabricated and maintained structure for adjustably masking the lateral edges of a suction drum in the manner desired.

For a more complete understanding of the above and other features and advantages of the invention, reference should be made to the following detailed description of a preferred embodiment of the invention and to the accompanying drawings.

DESCRIPTION OF THE DRAWINGS

FIG. 1 is a schematic side elevational view of a typical two-drum suction dryer system for the processing of web material, such as tubular knitted fabric.

FIG. 2 is a simplified and schematic plan view of a conventional suction dryer drum of the prior art, illustrating a typical condition with a relatively narrow web of material passing over a drum of significantly greater width capacity.

FIG. 3 is an illustrating, similar to FIG. 2, but schematically illustrating the masking of the lateral edges of the dryer drum in accordance with the invention.

FIG. 8 is an enlarged, fragmentary cross sectional view as taken along line 8—8 of FIG. 7.

FIGS. 9 and 10 are elevational views of an individual bellows section and a supporting rib associated therewith, as incorporated in the apparatus of the invention.

FIG. 11 is a fragmentary elevational view showing a portion of a bellows section assembled with a rib section.

FIG. 12 is a fragmentary elevational view taken as looking along line 12—12 of FIG. 11.

FIG. 13 is a cross sectional view as taken generally on line 13—13 of FIG. 11.

DESCRIPTION OF PREFERRED EMBODIMENTS

Figure 4:
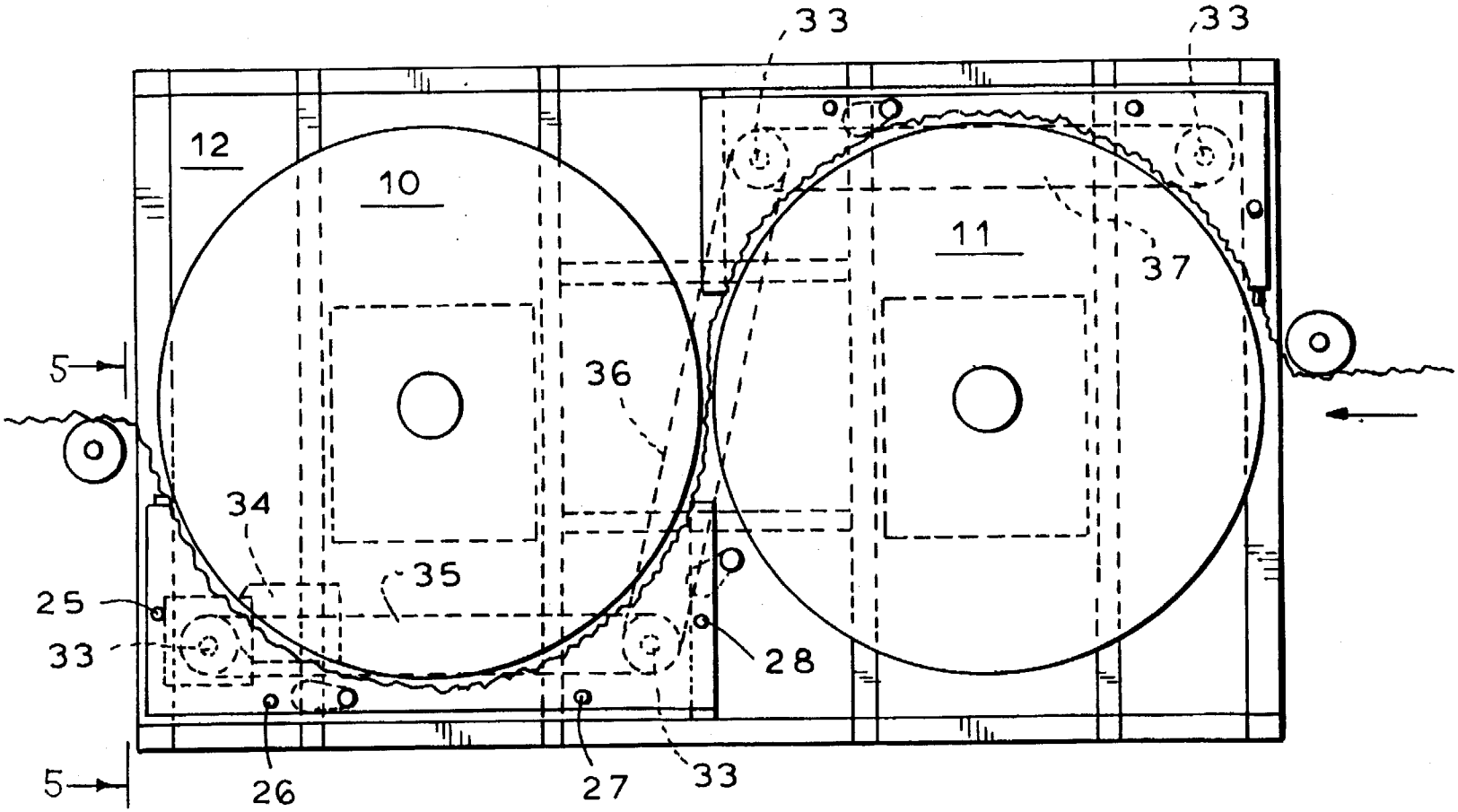
FIG. 4 is a side elevational view, with parts broken away, of a two-drum suction dryer installation employing adjustable masking means according to the invention.

Referring now to the drawing, the reference numerals 10, 11 designate generally a pair of suction drum elements mounted for rotation within a housing 12. A typical such drum, illustrated in FIG. 2, is formed of perforate sheet material, in some cases, or more preferably of a metal mesh material 13. In either case, the material forming the outer cylindrical wall of the drum is highly perforate to accommodate relatively free flow of ambient air therethrough. In a typical suction dryer installation, the fabric 14 to be processed is delivered into the housing 12, passed over a guide roller 15 and deposited on the surface of the first drum 10. The fabric is carried by the rotating drum over an arc of about 180°, at which point the fabric is transferred onto the surface of the second drum 11. After being carried by the second drum 11 over an arc of about 180°, the fabric passes around a guide roller 16 and is discharged. Depending upon the desired capacity of equipment, a suction drum system may comprise a single processing drum. More typically, however, a system comprises at least two drums, arranged in cooperating pairs as reflected in FIG. 1, and multiple sets of such pairs may be provided where necessary, all as generally well known in the art.

The interior of each of the suction drums is associated with a suction blower, schematically indicated at 17 in FIGS. 2 and 3 which reduces the pressure within the interior of the drum and causes a flow of ambient air from the interior of the housing 12 in a generally radial direction through the perforate cylindrical wall of the drum and through the fabric being conveyed thereon. Some of the air withdrawn from the interior of the suction drum is suitably processed, typically by the addition of heat, and recirculated to the interior of the housing 12. Portions of the air may be discharged to atmosphere.

Inasmuch as ambient air from the housing 12 will tend to flow generally radially into the suction drums 10, 11 from all surrounding areas, it is conventional to mask those arcuate portions of the drums not involved in the support and processing of the fabric web 14. To this end, the schematically illustrated system of FIG. 1 is provided with internal, semi-cylindrical masking elements 18, 19, which substantially limit the flow of ambient air into the interior of the suction drums to the arcuate portions thereof over which the fabric is travelling, sometimes referred to herein as the processing portions.

In any suction drum installation, the individual drums 10, 11 have a predetermined width, calculated to receive a fabric web 14 of the maximum width intended for the given processing line. In typical commercial processing, however, it is commonly the case that, at different times, fabrics of various widths are delivered to the dryer systems for processing. Thus, it is not uncommon in the prior art for a condition, such as shown in FIG. 2, to exist, where the fabric web 14 occupies only a fraction of the total width of the suction drum. When this condition exists, ambient air from the housing 12 enters the interior of the suction drum not only through the fabric 14, but also through the unoccupied lateral edge areas of the processing section, indicated by the numerals 20, 21 in FIG. 2. Obviously, air flowing through the exposed lateral edge areas of the drum performs no useful function and simply consumes energy in the course of its circulation. Moreover, and perhaps more significantly, for a given amount of suction applied to the interior of a partially covered suction drum, ambient air finds an easier path through the uncovered portions of the perforate drum wall than through the combined resistance of the fabric and the covered portions of the drum wall. Thus, the fabric-covered portions of the suction drum may receive even less than their proportionate share of the flow of processing air, because the air will tend to seek a path of lower resistance. This has been a long standing problem in the trade, but efforts to overcome it have thus far been unsuccessful, at least from a practical standpoint. In some cases, narrow width fabric can be run in multiple side-by-side strings so that, collectively, the several webs cover a greater area of the suction drum. But not all processing lines are suitable for this, and particular fabric widths may not readily accommodate side-by-side processing. Manually masking the otherwise exposed side edges of the drums has been practiced, but it is at best difficult and time consuming and is unsatisfactory in many ways, because it must be redone for every change in fabric width.

In accordance with the present invention, a novel and wholly practical mechanism is provided for selectively and adjustably masking side edge portions of suction dryer drums over a substantially arcuate extent of the processing portions thereof, so that processing air is caused to flow principally through the fabric to be processed, while accommodating in-process adjustment if necessary and allowing easy adjustment for changeover from one width fabric to another.

In a most advantageous embodiment, the system of the invention includes, for each processing drum, at least one and preferably a pair of opposed bellows masking structures, as indicated generally by the reference numerals 22 in FIG. 3. Each such bellows structure includes a fixed outer side plate 23 (FIG. 5) and a movable inner side plate 24. A plurality (advantageously four) of guide shafts 25–28 extend transversely across the apparatus from the outer side plate 23 at one side to its counterpart at the opposite side of the machine. The guide shafts 25–28 slidably support and guide the respective movable inner side walls 24 between outer or retracted limit positions, in which the side plates 24 are at the outer side limits of an associated suction drum, and inner limit positions, in which the spacing between opposed inner side walls 24 is at a predetermined minimum.

Figure 7:
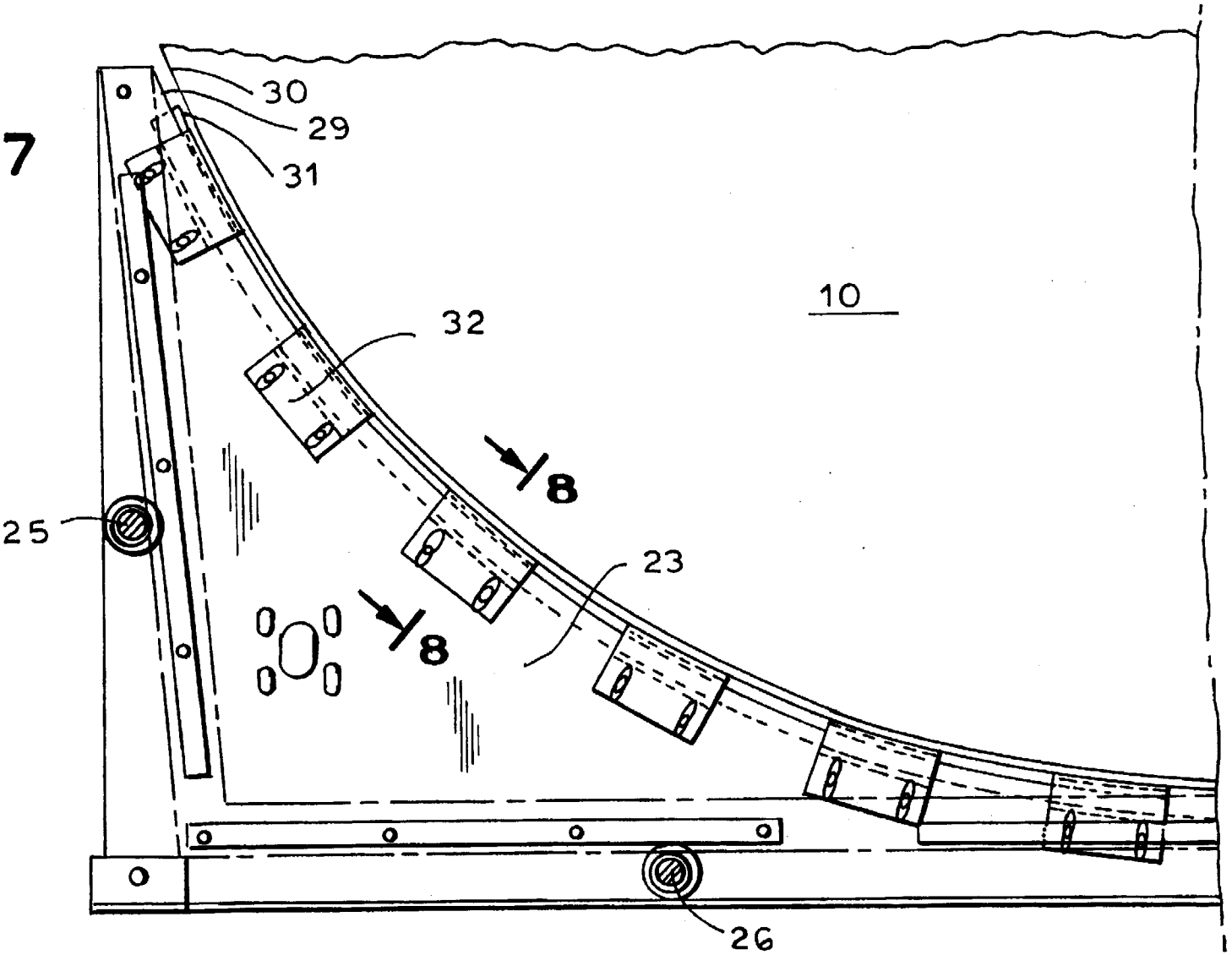
FIG. 7 is a fragmentary elevational view illustrating details of construction of a fixed outer wall member forming part of the masking means of the invention.

An outer side wall member 23, partially shown in FIG. 7, has an arcuately concave edge 29 closely conforming to the cylindrical outer surface 30 of a suction drum but preferably spaced slightly therefrom. A sealing gasket 31 is disposed about the arcuate edge 29, being carried in a plurality of adjustable brackets 32 (see FIG. 8), and serving to substantially close the gap between the side wall edge 29 and the drum surface 30. The inner side walls 24 are of generally similar configuration and construction to the outer side walls, and also carry a sealing gasket of similar to the gasket 31. However, while the outer side walls 23 are fixed to the dryer housing, the inner side walls are slidably supported for controlled transverse movements on the guide rods 25–28.

Figure 5:
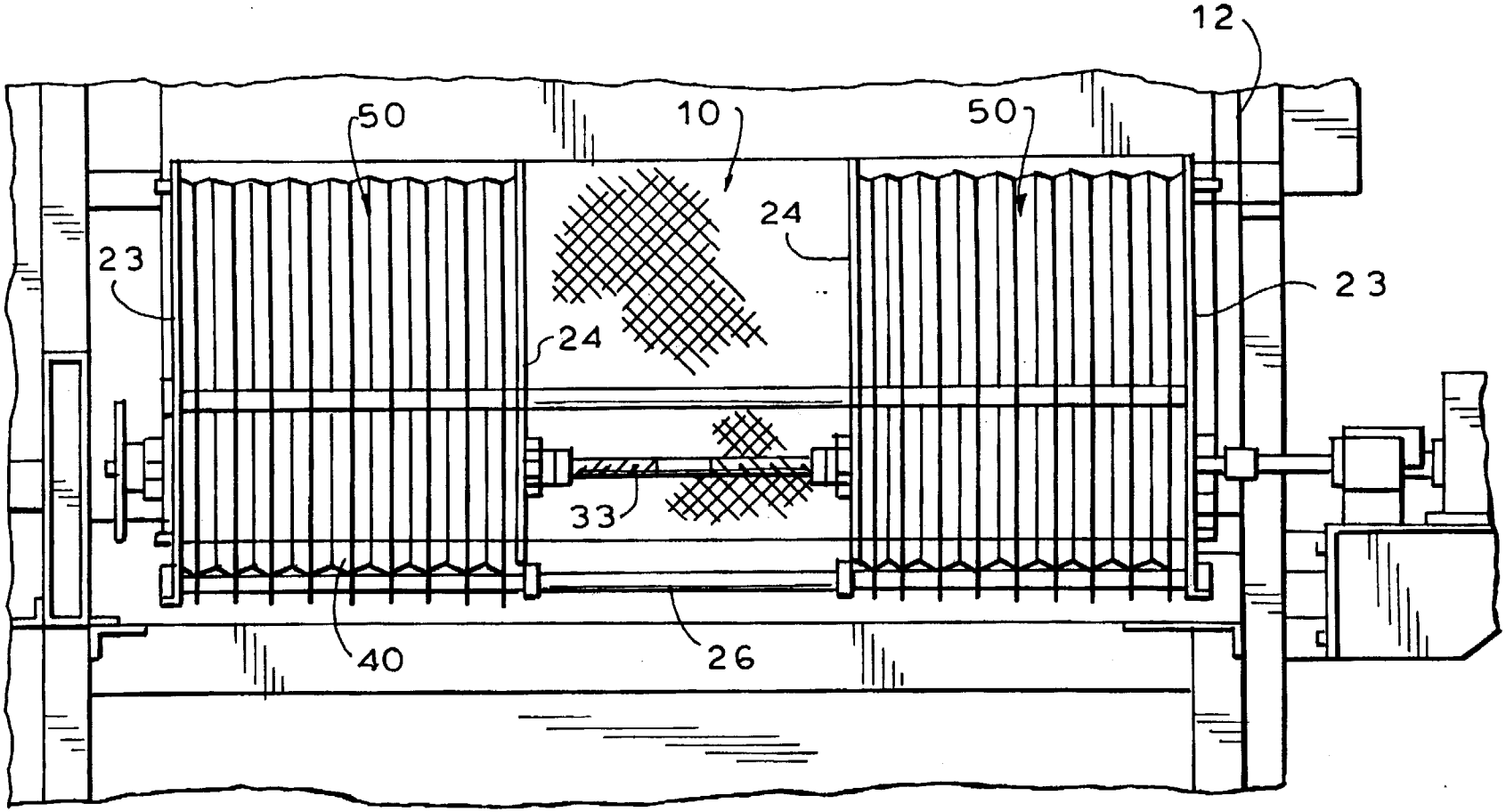
FIG. 5 is an end elevational view as looking generally along line 5—5 of FIG. 4, with parts broken away to show internal details, and with the masking means in an extended configuration.
Figure 6:
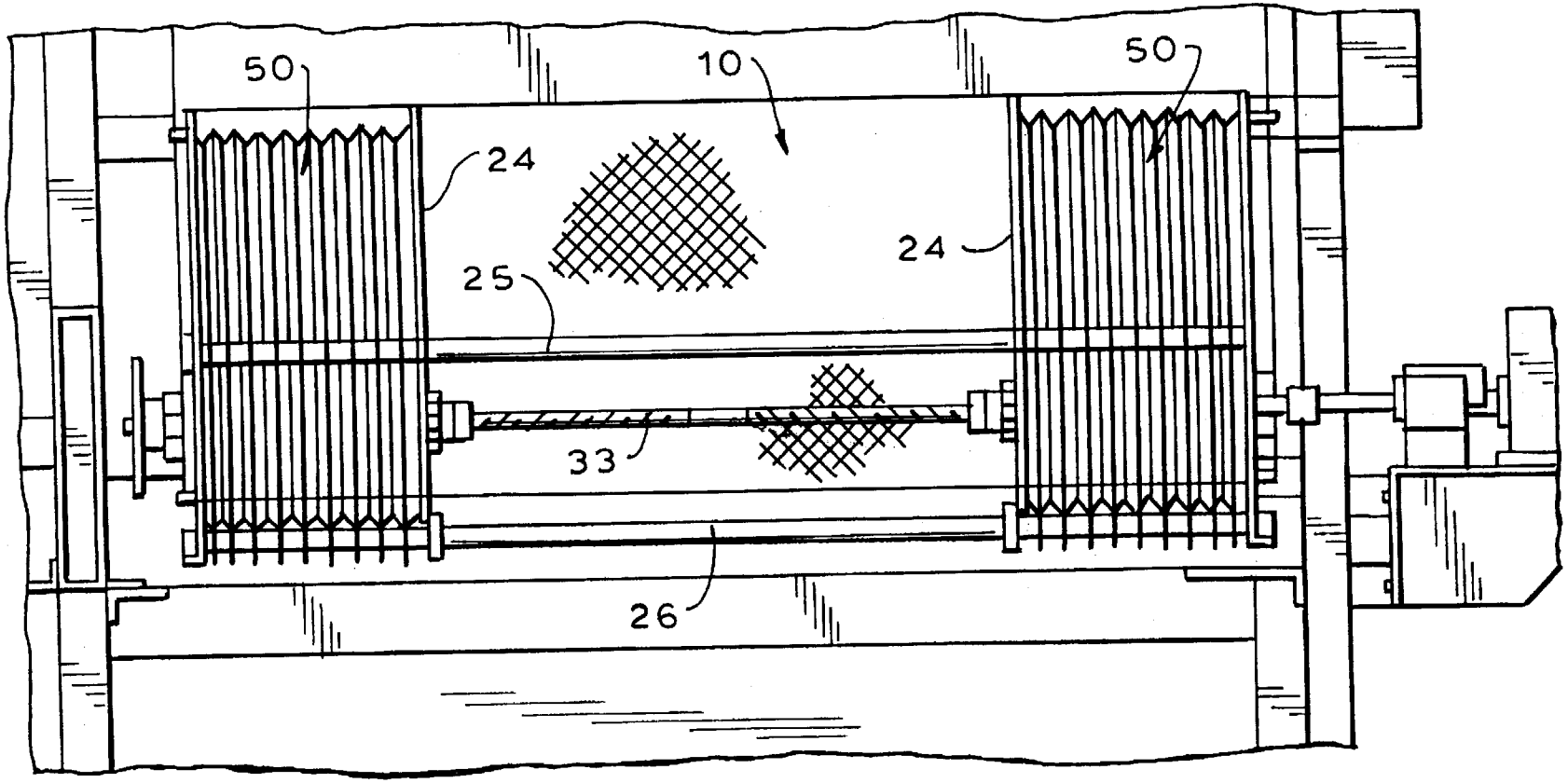
FIG. 6 is a view, similar to FIG. 5, illustrating the masking means of the invention in a retracted configuration.

Lateral adjustment of the inner side walls 24 is accomplished by means of a plurality of shafts 33 having oppositely threaded end portions. Advantageously there are two such shafts 33 for each adjustable bellows assembly. In the arrangement as illustrated in FIGS. 4 and 5, a single control motor 34 is employed for simultaneously adjusting the bellows assembly of each of two related processing drums 10, 11. To this end, the motor 34 is connected directly to one of the shafts 33, and by way of chains 35–37 to all of the other shafts, for rotation of all of the shafts 33 in unison.

Figure 10:
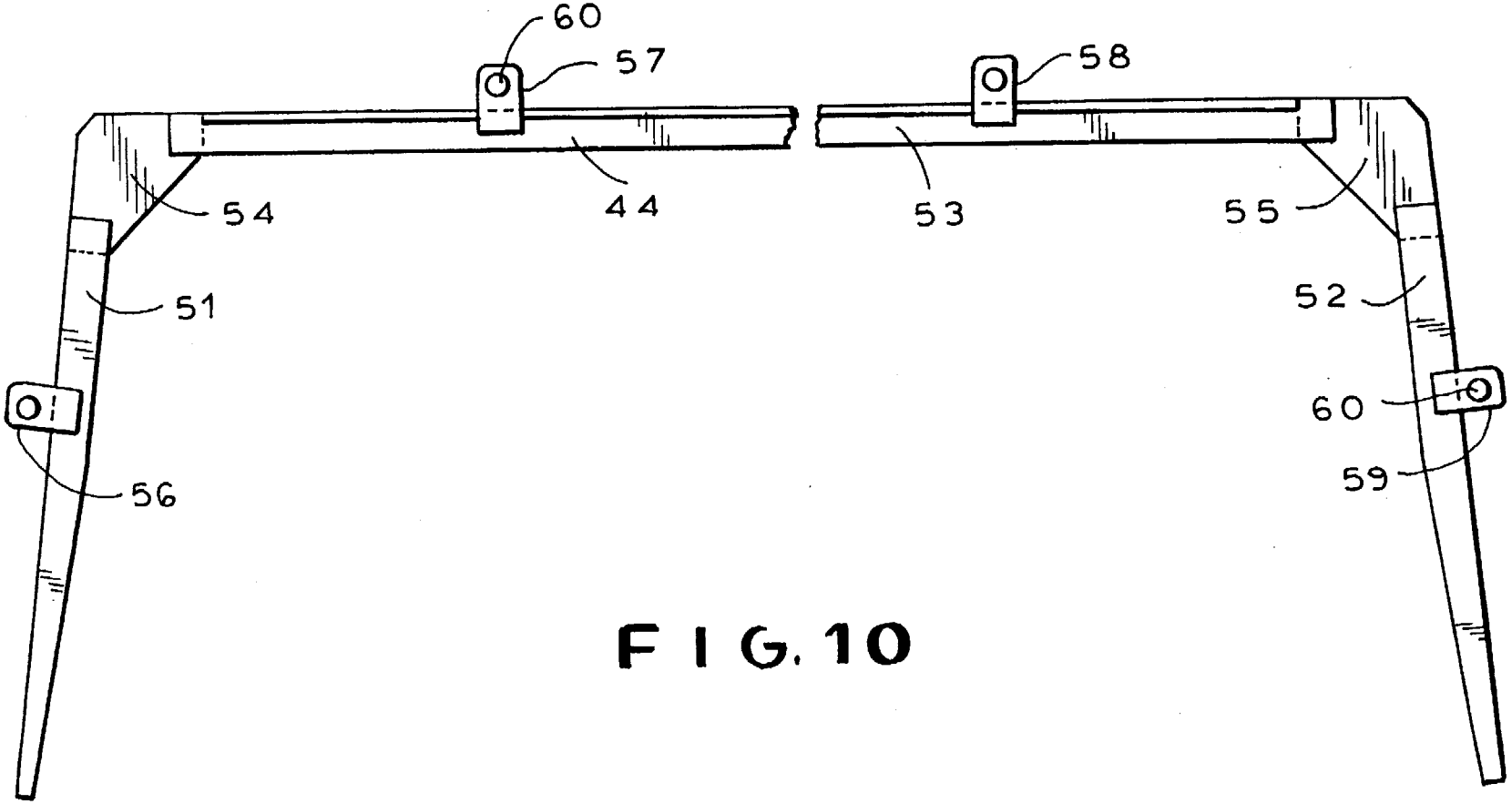

Joining the respective outer and inner side wall elements 23, 24, and forming an enclosure between them, are a plurality of bellows sections 40, each consisting of a pair of bellows strips 41, 42 joined at outer edge margins 43 and supported internally by rigid metal rib elements 44 (FIG. 10). The individual bellows strips, of which an example strip 41 is shown in FIG. 9, are formed of a durable, heat resistant Kevlar-Teflon material, formed as relatively narrow strips of, for example, one inch in width and fabricated in a somewhat U-shaped configuration, comprised of opposite side elements 45, 46 and an elongated connecting element 47 joining outer ends of the respective side elements. Pairs of such fabricated U-shaped strips are joined together along narrow, outside edge margins 43, by adhesive and/or stitching. A complete bellows wall 50 is constructed by joining a plurality of such pairs of assembled strips 41, 42 at inner edge margins 48 (FIG. 13) by adhesive and/or stitching.

A complete bellows wall 50, formed of strips 41, 42 joined as shown in FIG. 13, has inadequate stiffness to hold its intended form against pressure differentials established by suction blowers 17, even though such pressure differentials may be relatively low, in the nature of 2–3 inches of water, because of the very substantial area of each bellows wall in a typical commercial system. In a preferred embodiment of the invention, therefore, each pair of bellows strips 41, 42 is supported internally by a rigid rib 44. The ribs, shown in FIG. 10, are fabricated of sheet steel of, by way of illustration, eighteen gauge. Each rib element preferably is comprised of opposed side elements 51, 52, a transverse connecting element 53 and corner gussets 54, 55. Each rib 44 has four tab-like extensions projecting outwardly therefrom and provided with an opening 60 adapted for slidable reception over one of the several guide rods 25–28.

As reflected in FIGS. 9, 11 and 12, the individual bellows strips 41, 42 are formed with a plurality of shallow cut-out portions 61, where the outer edge portions 43 remain unattached. The locations of these cut-out portions 61 correspond to the locations of the several tab-like extensions 56–59 of the supporting ribs 44.

In the complete bellows assembly, each bellows section 40, comprising a joined pair of bellows strips 41, 42, is supported by a rib 44 which is of a size and Shape to be received snugly within the V-shaped apex of the bellows section, with the several tab-like extensions 56–59 projecting through openings 62 formed at the shallow cut-out portions 61, as shown in FIGS. 11–13. Thus, each bellows section 40 of the entire bellows wall 50 is both supported by an individual rib 44 and guided in lateral movement by the fact that the several tab-like extensions 56–59 slidably engage the guide rods 25–28. At each end, of the bellows wall, a bellows strip section 41 or 42 is clamped and sealed to the outer or inner side wall plate 23, 24, as the case may be, to complete the enclosure.

The three-sided bellows structure, while providing for relatively straight forward fabrication, enables the bellows structure to be configured to mask a substantial arcuate section of the processing portion of the drum. Such processing portion, in the illustrated form of the invention, covers an arc of approximately 180°. Because it is generally desirable to mount a cooperating pair of suction drums 10, 11 in closely spaced relation, to facilitate transfer of the fabric from one drum to the other, it is not practicable for the bellows structure to embrace a full 180° of arc. Nevertheless, the structure of the invention enables the end extremities of the bellows structure to project as far as practicable to the midpoints of the suction drums. Because of the relatively restricted areas, in the regions where the suction drums approach each other, air losses in these regions are relatively modest.

The system of the invention makes it commercially practicable, for the first time, to provide for effective, selectively adjustable width control of suction drum dryers, so that the effective width of the suction drums can be quickly adjusted to a width appropriate to the fabric being processed. By simply actuating the drive motor 34, the machine operator can precisely expand or contract the bellows structures and thereby increase or reduce the width of the open central portion of the suction drums over an entire processing line. In a practical commercial embodiment of the invention, it has been shown possible to achieve both higher processing speeds and substantial increases in productivity (up to 30%). In addition, it has been found that, by being able to direct significantly greater proportions of the processing air through the fabric, the temperature of the processing air may be lowered with respect to the requirements of a conventional suction dryer. Not only does this result in a savings in energy, but the lower operating temperatures also reduce the possibility of damaging the fabric.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A suction drum system for processing web materials of various widths, which comprises (a) a housing provided with an inlet and outlet for web material, (b) a processing drum mounted for rotation within said housing and having a perforate outer circumferential wall with spaced-apart lateral margins defining its width, (c) said inlet and outlet defining, with said processing drum, a processing path for directing said web to travel around a predetermined arcuate processing portion of said outer circumferential wall while being supported thereon, (d) suction means communicating with the interior of said drum for partially evacuating said interior and causing the flow of air from areas external of said drum through said perforate circumferential wall, (e) first masking means for masking an arcuate portion of said circumferential wall to limit the flow of air through said perforate circumferential wall substantially to said processing portion, (f) second masking means positioned externally of said processing drum for selectively and adjustably masking at least one lateral margin of said perforate circumferential wall, to limit the flow of air through said perforate wall to selected circumferential areas of said processing portion, and (g) means operable externally of said housing for controllably adjusting said second masking means.

2. A suction drum system according to claim 1, wherein (a) said first masking means comprises means masking said perforate circumferential wall across substantially its full width, (b) said second masking means serving to mask opposed lateral margins of said circumferential wall to confine the inwardly directed flow of air into the interior of said drum substantially to a central area of said processing portion between said lateral margins.

3. A suction drum system according to claim 2, wherein (a) said transversely disposed supports are positioned externally of a closed area defined by said bellows walls and said processing drum, (b) said intermediate support ribs are positioned substantially within said closed area, and (c) support tabs on said intermediate support ribs extend outwardly through said bellows walls and are movably engaged by said transversely disposed supports.

4. A suction drum system according to claim 3, wherein (a) said processing portion of said circumferential wall comprises approximately one-half the circumference thereof, (b) said inner and outer walls have concave arcuate edges extending over a substantial portion of said processing portion and of a contour to closely conform to the curvature of said circumferential wall, and (c) said inner and outer walls each have first and second relatively straight edges of substantially equal length extending from opposite end extremities of said arcuate edges and joining with opposite ends of a third relatively straight edge spaced from said arcuate edge.

5. A suction drum system according to claim 4, wherein (a) said bellows walls are formed of a plurality of bellows sections, each comprising a pair of bellows strip sections joined in pairs along outer edge margins to be of V-shaped cross section, (b) an intermediate support rib is positioned within each pair of joined strips for supporting the same, and (c) the pairs of joined strips are joined with adjacent such pairs along inner edge margins of said strips.

6. A suction drum system according to claim 1, wherein (a) said suction drum system comprises a plurality of selectively and adjustably masked processing drums over which a web is passed in sequence.

7. A suction drum system for processing web materials of various widths, which comprises (a) a housing provided with an inlet and outlet for web material, (b) a processing drum mounted for rotation within said housing and having a perforate outer circumferential wall with spaced-apart lateral margins defining its width, (c) said inlet and outlet defining, with said processing drum, a processing path for directing said web to travel around a predetermined arcuate processing portion of said outer circumferential wall while being supported thereon, (d) suction means communicating with the interior of said drum for partially evacuating said interior and causing the flow of air from areas external of said drum through said perforate circumferential wall, (e) first masking means for masking an arcuate portion of said circumferential wall to limit the flow of air through said perforate circumferential wall substantially to said processing portion, (f) second masking means for selectively and adjustably masking at least one lateral margin of said perforate circumferential wall, to limit the flow of air through said perforate wall to selected circumferential areas of said processing portion, (g) means operable externally of said housing for controllably adjusting said second masking means, (h) said second masking means comprising a bellows structure comprising adjustably separated inner and outer side walls each having an arcuate edge closely embracing said perforate circumferential wall in the region of said processing portion, and (i) said inner and outer side walls being connected by expandable-retractable bellows walls to mask the area of said processing portion between said inner and outer side walls.

8. A suction drum system according to claim 7, wherein (a) said outer side wall is fixed adjacent an end of said drum, (b) a plurality of transversely disposed supports are provided for slidably supporting said inner side wall for adjustable lateral movement toward and away from said outer side wall, and (c) a plurality of intermediate support ribs are slidably mounted on said transversely disposed supports between said inner and outer side walls for supporting said bellows walls.

9. A suction drum system according to claim 7, wherein (a) bellows structures for provided at each side of said processing drum for selectively and adjustably masking margins at each side thereof.

10. A suction drum system for processing web materials of various widths, which comprises (a) a housing provided with an inlet and outlet for web material, (b) a processing drum mounted for rotation within said housing and having a perforate outer circumferential wall with spaced-apart lateral margins defining its width, (c) said inlet and outlet defining, with said processing drum, a processing path for directing said web to travel around a predetermined arcuate processing portion of said outer circumferential wall while being supported thereon, (d) suction means communicating with the interior of said drum for partially evacuating said interior and causing the flow of air from areas external of said drum through said perforate circumferential wall, (e) first masking means for masking an arcuate portion of said circumferential wall to limit the flow of air through said perforate circumferential wall substantially to said processing portion, (f) second masking means for selectively and adjustably masking opposite lateral margins of said perforate circumferential wall, to limit the flow of air through said perforate wall to selected circumferential areas of said processing portion, (g) means operable externally of said housing for controllably adjusting said second masking means, (h) said first masking means comprises means masking said perforate circumferential wall across substantially its full width, (i) said second masking means serving to mask opposed lateral margins of said circumferential wall to confine the inwardly directed flow of air into the interior of said drum substantially to a central area of said processing portion between said lateral margins, (j) said second masking means comprises laterally extendable and retractable flow control members closely embracing outer surface portions of the said processing portion of said drum at each side thereof, and (k) control means for simultaneously extending and retracting said flow control members at each side to vary the effective width of said processing portion.

* * * * *